US006357061B1

(12) United States Patent
Gonzalez

(10) Patent No.: US 6,357,061 B1
(45) Date of Patent: Mar. 19, 2002

(54) BATH AIR MATTRESS CUSHION

(76) Inventor: Denise M. Gonzalez, 5622 Via Campo St., Los Angeles, CA (US) 90022

( * ) Notice: Subject to any disclaimer, the term of this patent is extended or adjusted under 35 U.S.C. 154(b) by 0 days.

(21) Appl. No.: 09/736,998

(22) Filed: Dec. 14, 2000

(51) Int. Cl.[7] ..... A47K 3/02

(52) U.S. Cl. ..... 4/580; 4/581; 4/582; 4/583; 4/588

(58) Field of Search ..... 4/580, 581, 582, 4/583, 584, 585, 586, 587, 588, 659, 654, 655; 5/632, 633, 634, 655.3, 656, 646, 652, 653, 654; 297/452.41, 381, 382; 441/125–127, 129, 130

(56) References Cited

U.S. PATENT DOCUMENTS

| | | | | |
|---|---|---|---|---|
| 2,350,679 | A | * | 6/1944 | Hann |
| 2,461,880 | A | | 2/1949 | Curran |
| 2,582,439 | A | | 1/1952 | Kavanagh |
| 3,058,122 | A | * | 10/1962 | McDaniel et al. |
| D197,397 | S | | 1/1964 | Emery |
| 3,235,892 | A | | 2/1966 | Emery |
| D204,444 | S | | 4/1966 | Emery |
| D204,592 | S | | 5/1966 | Emery |
| 3,386,106 | A | * | 6/1968 | Clemens |
| 3,492,988 | A | * | 2/1970 | De Mare |
| 3,740,095 | A | * | 6/1973 | Nail |
| 3,835,483 | A | * | 9/1974 | Emery et al. |
| 3,909,859 | A | * | 10/1975 | Harris |
| 3,931,652 | A | * | 1/1976 | Navarra |
| 4,442,838 | A | * | 4/1984 | Samson et al. |
| D298,716 | S | | 11/1988 | Kaplan |
| 4,872,229 | A | | 10/1989 | Brady |
| 4,891,848 | A | | 1/1990 | Carter |
| 5,005,902 | A | * | 4/1991 | Farnworth et al. |
| 5,020,168 | A | | 6/1991 | Wood |
| D320,135 | S | | 9/1991 | Magnin |
| D320,711 | S | | 10/1991 | Olsen |
| 5,088,434 | A | * | 2/1992 | Harding |
| 5,140,713 | A | | 8/1992 | Pesterfield |
| 5,144,703 | A | | 9/1992 | Maire |
| 5,186,667 | A | * | 2/1993 | Wang |
| 5,195,192 | A | | 3/1993 | Garde |
| D335,036 | S | | 4/1993 | Simmons |
| D337,231 | S | | 7/1993 | Levien |
| D341,983 | S | | 12/1993 | Wang |
| 5,320,369 | A | * | 6/1994 | Bears |
| D349,625 | S | | 8/1994 | Dapalma |
| 5,406,653 | A | | 4/1995 | Todor |
| D359,870 | S | | 7/1995 | McLaughlin |
| D360,256 | S | | 7/1995 | Gharehgozlou |
| 5,437,068 | A | | 8/1995 | Fisher |
| D364,303 | S | | 11/1995 | Larsen |
| D365,485 | S | | 12/1995 | Rossman |
| 5,499,417 | A | | 3/1996 | Wang |
| 5,535,458 | A | | 7/1996 | Siverly |
| 5,604,945 | A | | 2/1997 | Fisher et al. |
| D380,041 | S | | 6/1997 | Bengston et al. |
| D384,852 | S | | 10/1997 | Koshaba et al. |
| D385,340 | S | | 10/1997 | Giese |
| 5,699,569 | A | * | 12/1997 | Schwarz-Zohrer |
| D392,495 | S | | 3/1998 | Baousson |
| 5,735,000 | A | * | 4/1998 | Pfaeffle |
| D394,978 | S | | 6/1998 | Smith |
| 5,839,132 | A | * | 11/1998 | Rooney |
| 6,036,555 | A | * | 3/2000 | Takacs |
| D422,154 | S | * | 4/2000 | Lieberman et al. |
| 6,227,925 | B1 | * | 5/2001 | Boddy |

* cited by examiner

*Primary Examiner*—Charles R. Eloshway
*Assistant Examiner*—Khoa D. Huynh
(74) *Attorney, Agent, or Firm*—Fulwider Patton Lee & Utecht, LLP

(57) ABSTRACT

The inflatable bath air mattress cushion includes an inflatable back cushion portion, an inflatable mat cushion portion connected to the inflatable back cushion portion, a pair of inflatable side cushion portions connected to opposing sides of the inflatable back cushion portion, and an inflatable upper pillow cushion portion connected to the inflatable back cushion portion at the head end of the bath air mattress cushion. The inflatable back cushion portion, mat cushion portion, side cushion portion and upper pillow cushion portion each have inflation valves and suction cups on the bottom side, and a top covering of a layer of fabric.

22 Claims, 7 Drawing Sheets

BATH AIR MATTRESS CUSHION

BACKGROUND OF THE INVENTION

1. Field of the Invention

This invention relates generally to devices to aid a person in bathing, and more particularly concerns a bath air mattress cushion that can be secured in a bathing vessel such as a bath tub.

2. Description of Related Art

The hard and often comparatively cool interior surfaces of bathing vessels, such as bath tubs, can be extremely uncomfortable to persons who are ill or infirm, due to advanced age, medical conditions, or medical treatment such as radiation therapy or chemotherapy. The interior surfaces of such bathing vessels can also become dangerously slippery when wet and/or soapy. Bath mats can help provide a non-slippery surface to stand on in such bathing vessels, but these commonly are reasonably thin, only typically cover the lower inner surface of a bathing vessel, and do not provide cushioning or insulation against side surfaces of the bathing vessel.

Various types of bathing seats have been devised to provide cushioned neck and back support for a person in a bathing vessel. Typically, these are designed to be inserted in the bathing vessel, but such bathing seats also typically do not provide side cushions or insulation, arc commonly heavy, bulky, and difficult to store.

It would therefore be desirable to provide an inflatable bath air mattress cushion that can be easily secured within and removed from a bathing vessel, which is easily transported and stored when not in use, and that provides cushioned leg, back, and head support, as well as side cushioning and insulation from the surface of the bathing vessel for the arms and shoulders of a person using the bathing vessel. The present invention meets these needs.

SUMMARY OF THE INVENTION

Briefly, and in general terms, the present invention provides for an insulating inflatable bath air mattress cushion for use in a bath tub that can be easily inflated and secured within a bathing vessel, and that can be deflated and removed, for easy transportation and storage when not in use. The bath air mattress cushion provides cushioned leg, back, and head support, as well as side cushions for the arms and shoulders of a person using the bathing vessel.

The present invention accordingly provides for an inflatable bath air mattress cushion that includes an inflatable back cushion portion, and an inflatable mat cushion portion connected to the inflatable back cushion portion. In a presently preferred embodiment, the inflatable air mattress cushion advantageously includes a pair of inflatable side cushion portions connected to opposing sides of the inflatable back cushion portion, and an inflatable upper pillow cushion portion connected to the inflatable back cushion portion at a side of the inflatable back cushion portion opposing the inflatable mat cushion portion. The back cushion portion and mat cushion portion, are each preferably formed from a plurality of parallel, longitudinally extending tubes having interconnected interior inflation chambers, while the side cushion portions are each preferably formed from a plurality of generally triangular shaped tubes having interconnected interior inflation chambers radiating from a common location. A plurality of suction cups is provided on the bottom side of the bath air mattress cushion for securing the bath and mattress cushion to the surface of the bath tub. In a presently preferred embodiment, the top side of the bath air mattress cushion is covered with a layer of soft fabric, such as terry cloth.

These and other aspects and advantages of the invention will become apparent from the following detailed description and the accompanying drawings, which illustrate by way of example the features of the invention.

DETAILED DESCRIPTION OF THE PREFERRED EMBODIMENTS

Bathing vessels can become dangerously slippery when wet and/or soapy, and the hard, cool interior surfaces of bathing vessels such as bath tubs can also be a source of discomfort to bathers, particularly to those who are aged, ill or otherwise infirm. Bath mats typically do not provide any significant cushioning, and bath seats typically do not any provide side cushions, and are commonly heavy, bulky, and difficult to store.

Figures 1, 2:
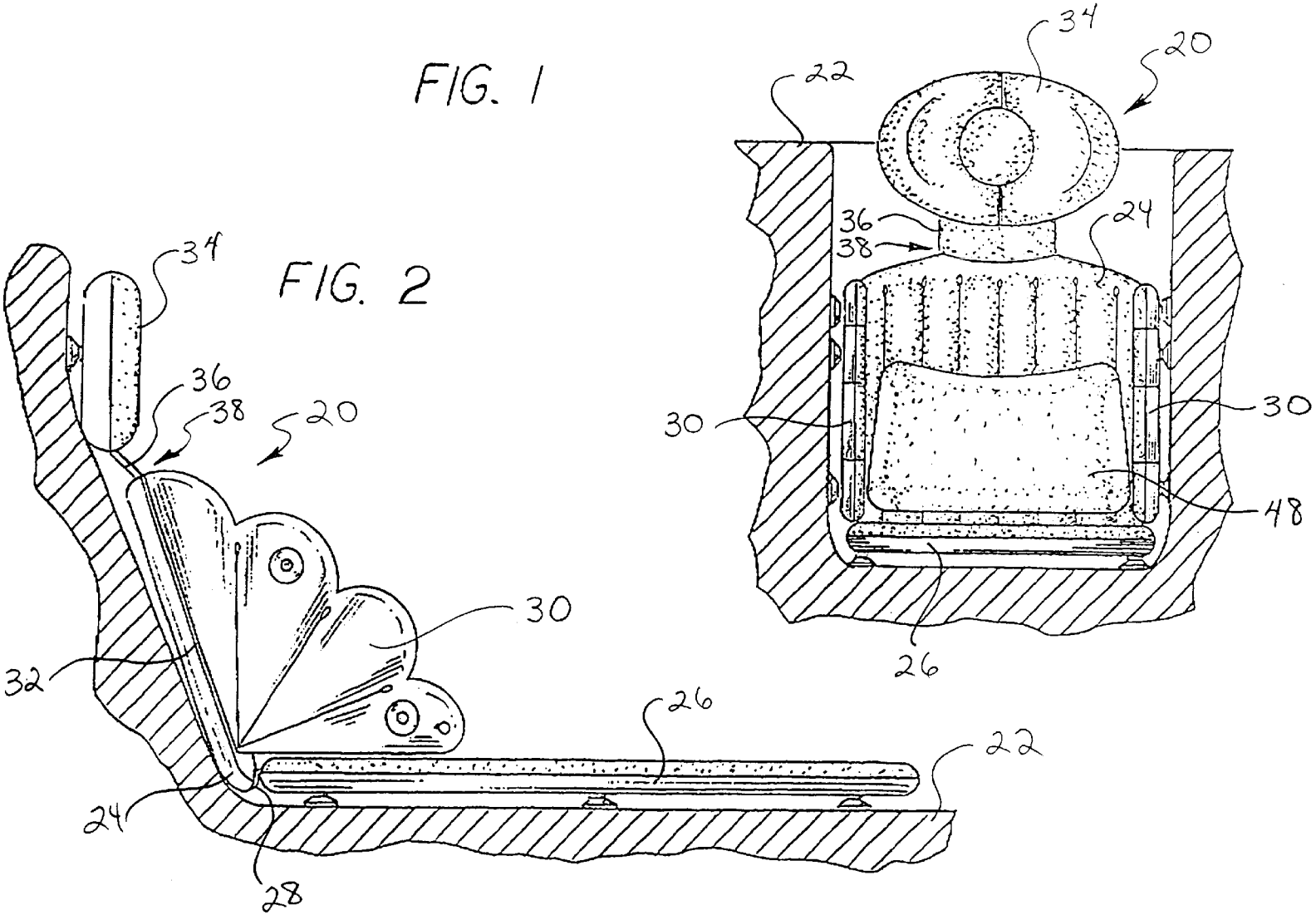
FIG. 1 is a transverse sectional view of the bath air mattress cushion of the invention secured in a bath tub.
FIG. 2 is side sectional view of the bath air mattress cushion of FIG. 1 secured in a bath tub.

As is illustrated in the drawings, the invention is accordingly embodied in an inflatable bath air mattress cushion 20 for use in a bathing vessel such as a bath tub 22, illustrated in FIGS. 1 and 2. Referring to FIGS. 1–8, in a presently preferred embodiment, the inflatable bath air mattress cushion includes an inflatable back cushion portion 24, an inflatable mat cushion portion 26 flexibly connected to the inflatable back cushion portion, such as by a length of thermoplastic sheet material 28, for example. A pair of inflatable side cushion portions 30 are flexibly connected to opposing sides of the inflatable back cushion portion and foldable along fold lines 32, and an inflatable upper pillow cushion portion 34 is flexibly connected to the inflatable back cushion portion at a side 38 of the inflatable back cushion portion opposing the inflatable mat cushion portion, such as by a length of thermoplastic sheet material 36, for example.

Figure 4:
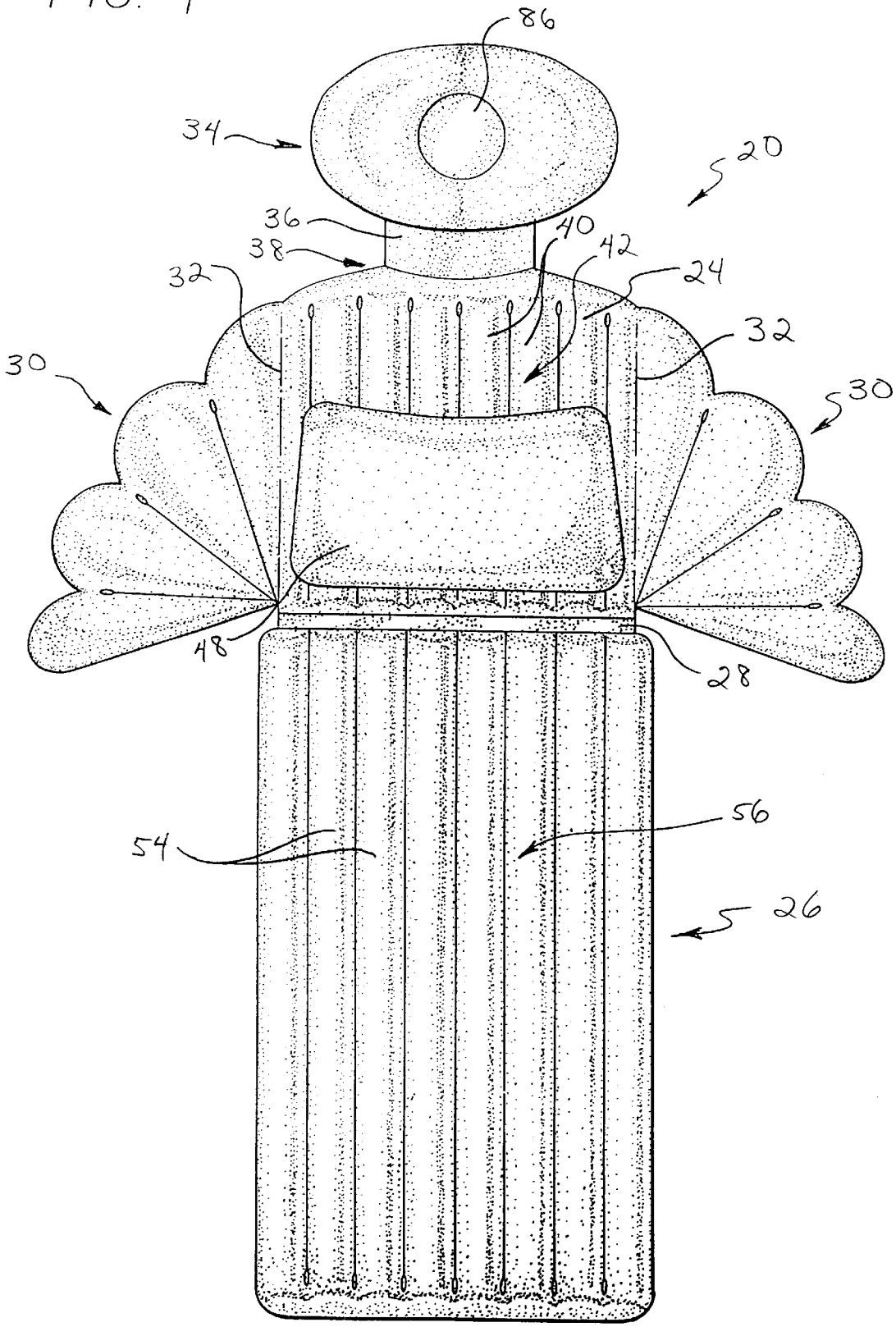
FIG. 4 is a top plan view of the bath air mattress cushion of FIG. 1.
Figure 5:
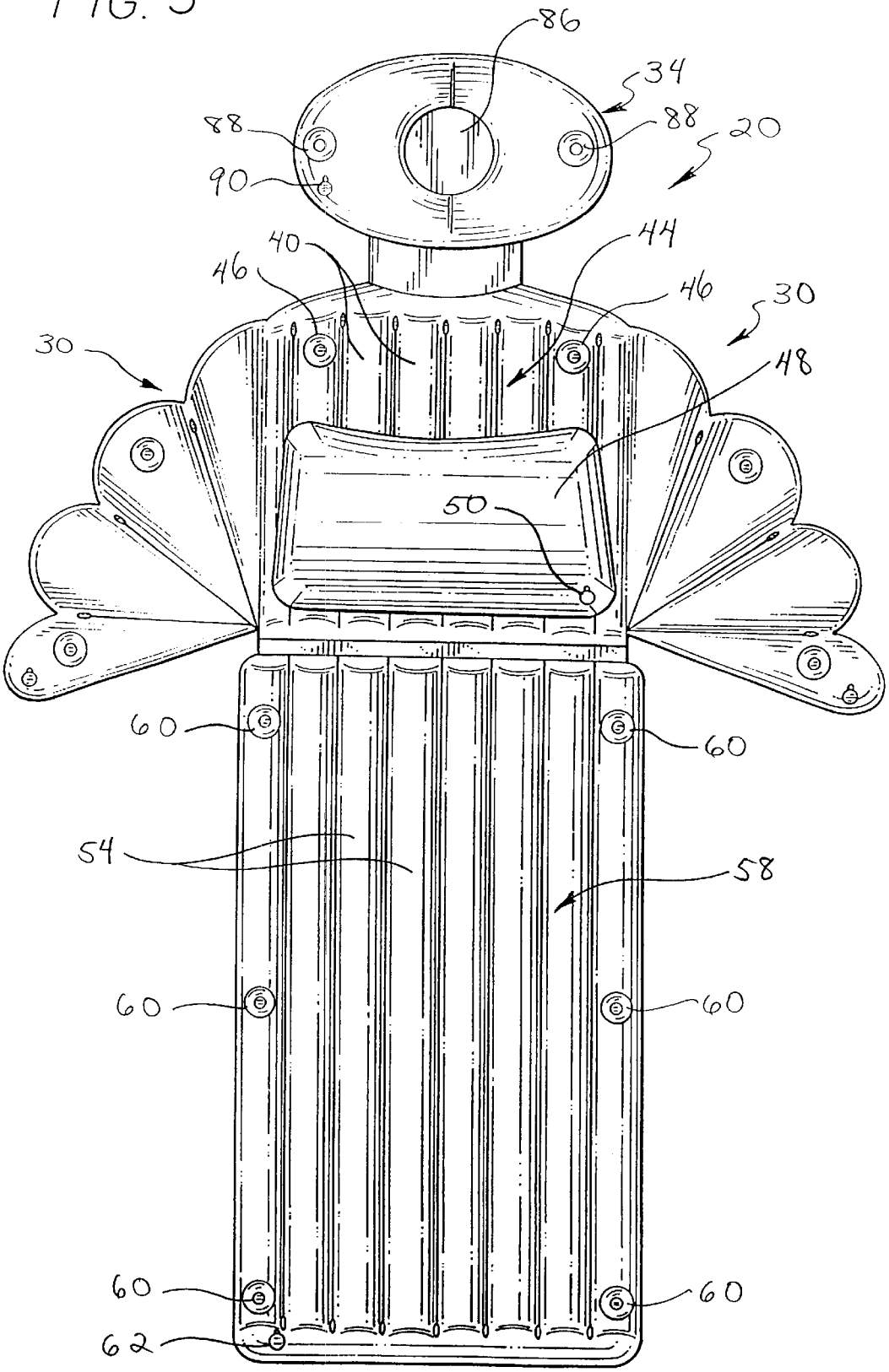
FIG. 5 is a bottom plan view of the bath air mattress cushion of FIG. 1.
Figure 6:
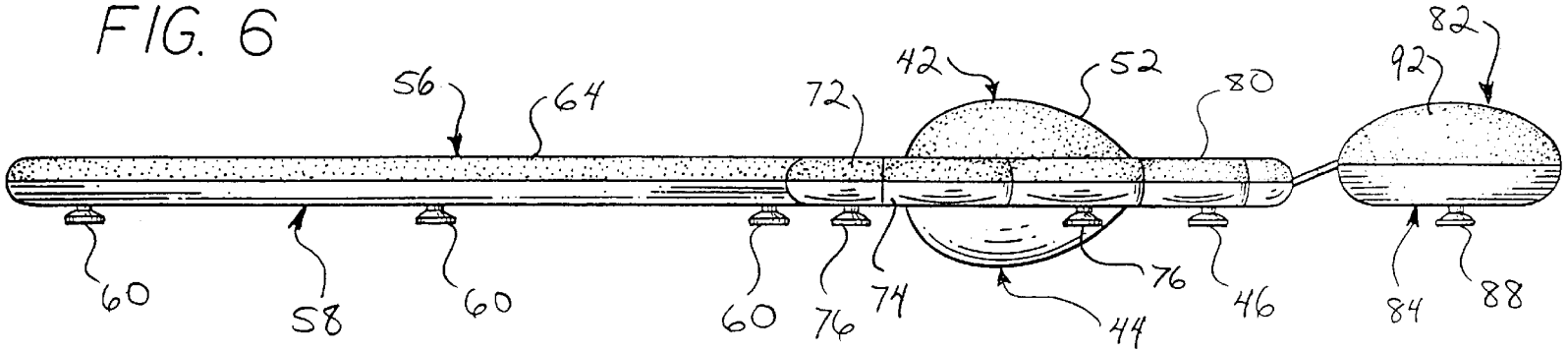
FIG. 6 is a side elevational view of the bath air mattress cushion of FIG. 1.
Figure 7:
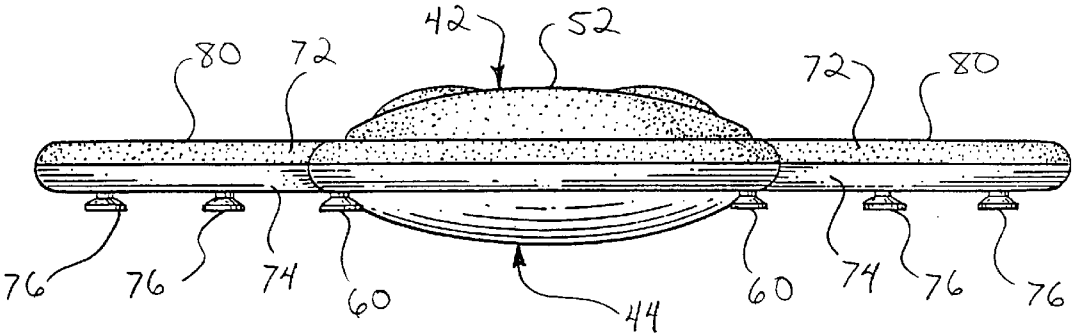
FIG. 7 is a rear elevational view of the bath air mattress cushion of FIG. 1.
Figure 8:
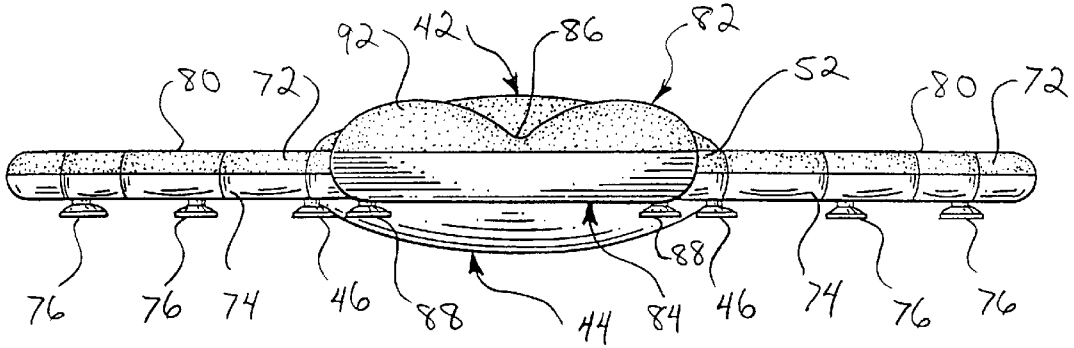
FIG. 8 is a front elevational view of the bath air mattress cushion of FIG. 1.

Referring to FIGS. 5–8, the inflatable back cushion portion preferably is formed from a plurality of parallel, longitudinally extending tubes 40 having interconnected interior inflation chambers (not shown). The fold lines of the side cushion portions are preferably parallel to the longitudinally extending tubes of the inflatable back cushion portion. The inflatable back cushion portion has a top side 42 adapted for contact with a bather, and a bottom side 44, adapted to rest upon the bathing vessel, both of which are best seen in FIGS. 6–8, with at least one suction cup 46 disposed on the bottom side adapted to be attached to the surface of the bath tub. The inflatable back cushion portion currently preferably has two suction cups. Referring to FIGS. 3–6, the inflatable back cushion portion preferably also includes an inflatable lower back support portion 48 having at least one interior inflation chamber (not shown) connected with the interior inflation chambers of the inflatable back cushion portion, to provide support for the lower back of a bather, and help the bather to maintain a natural "C" curve posture of the bather's lower back region.

The inflatable back air mattress cushion preferably includes at least one inflation valve. As is best shown in FIG. 5, the inflatable back cushion portion preferably includes at least one inflation valve 50 for individual inflation and deflation of the inflatable back cushion portion. The one or more inflation valves are currently preferably disposed on the bottom side of the inflatable back cushion portion. In a presently preferred embodiment, as is best seen in FIGS. 6–8, the inflatable back cushion portion is also covered on the top side with a layer of soft fabric 52, as will be further explained below.

The inflatable mat cushion portion preferably is formed by a plurality of parallel, longitudinally extending tubes 54 having interconnected interior inflation chambers (not shown), with a top side 56 and a bottom side 58 best seen in FIG. 6. As is best shown in FIG. 5, at least one suction cup 60 is disposed on the bottom side adapted to be attached to the surface of the bath tub. The inflatable mat cushion portion currently preferably has six suction cups. The inflatable mat cushion portion preferably also includes at least one inflation valve 62 for individual inflation and deflation of the inflatable mat cushion portion, and the inflation valve or valves are preferably disposed on the bottom side of the inflatable mat cushion portion, although location of one or more inflation valves on the top side may also be acceptable. In a presently preferred embodiment, the inflatable mat cushion portion is also covered on the top side with a layer of soft fabric 64, best seen in FIG. 6, as is further explained below.

Figure 3:
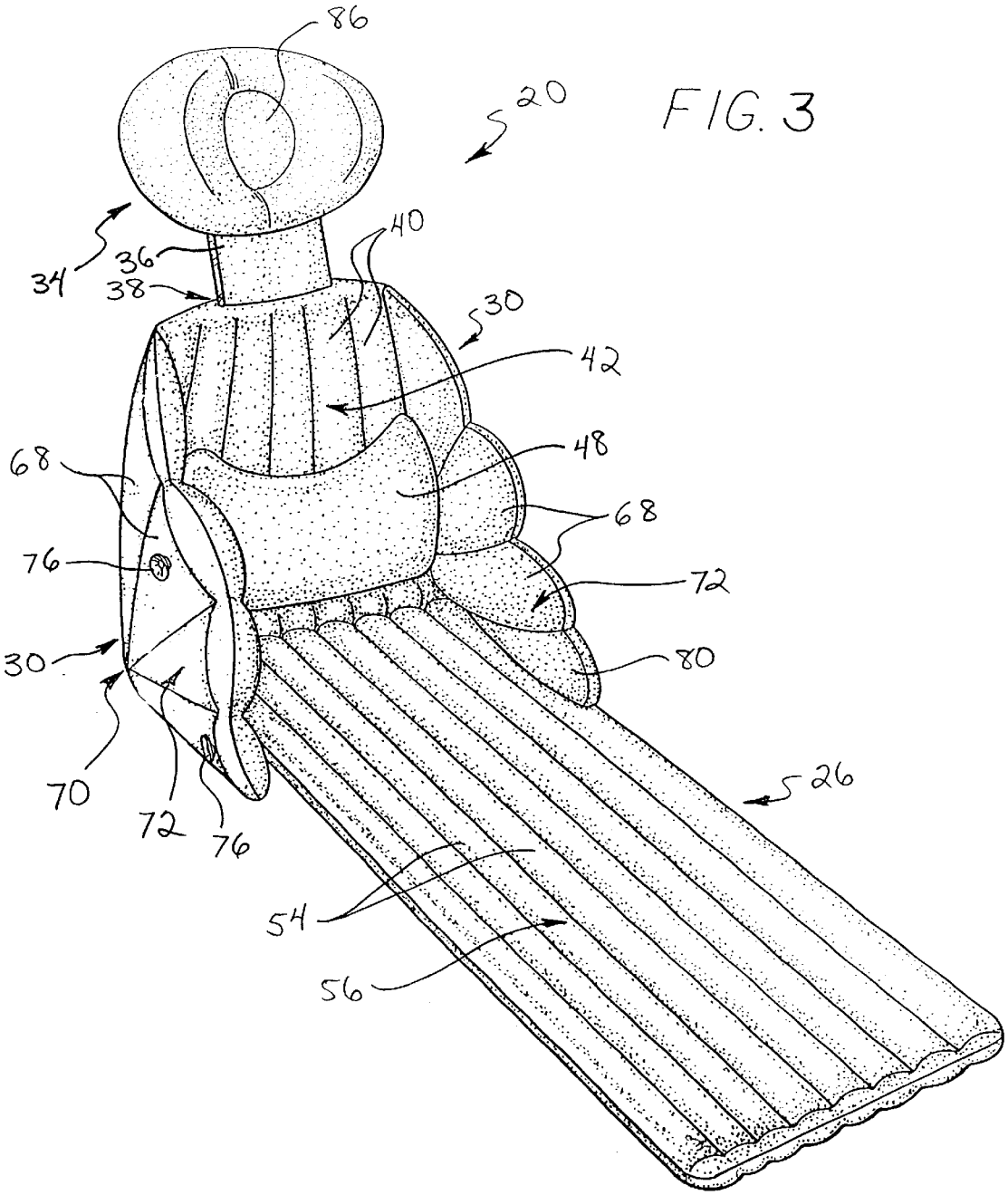
FIG. 3 is a front perspective view of the bath air mattress cushion of FIG. 1.

As is best seen in FIGS. 3, 4 and 5, each of the inflatable side cushion portions is preferably formed from a plurality of generally triangular shaped tubes 68 having interconnected interior inflation chambers (not shown), currently preferably radiating from a common location 70 adjacent to the lower mat cushion portion, although the triangular shaped tubes can alternatively radiate from the top corners of the back cushion portion near the upper pillow cushion portion. The inflatable side cushion portions also alternatively may be formed of a plurality of parallel, interconnected tubes, or another configuration of one or more interconnected tubes, flexibly joined to the sides of the inflatable back cushion portion. Each of the inflatable side cushion portions has a top side 72 and a bottom side 74 best seen in FIGS. 6–8, and at least one suction cup 76 disposed on the bottom side adapted to be attached to the surface of the bath tub. As is best illustrated in FIG. 5, each of the inflatable side cushion portions preferably has at least one inflation valve 78 for individual inflation and deflation of each inflatable side cushion portion, and as is shown best in FIGS. 6–8, each is preferably covered on the top side with a layer of soft fabric 80, as is further explained below.

The inflatable upper pillow cushion portion is preferably formed from at least one tube with at least one inflation chamber (not shown), and is typically formed as an annular or oval shaped tube ring. The inflatable upper pillow cushion portion has a top side 82 and a bottom side 84 best seen in FIGS. 6 and 8, preferably with a central depression 86 formed in at least the top side, for cradling the back of a bather's head. In a presently preferred embodiment, the central depression is formed by the annular or oval shaped tube ring by a centrally located heat-bonded region of the thermoplastic sheet material that forms the upper pillow cushion portion of the bath air mattress cushion, as is further explained below. Referring to FIG. 5, the inflatable upper pillow cushion portion also includes at least one suction cup 88 on the bottom side adapted to be attached to the surface of the bath tub. At least one inflation valve 90 for individual inflation and deflation of the inflatable upper pillow cushion portion is preferably disposed on the bottom side of the inflatable upper pillow cushion portion. As is best shown in FIGS. 6 and 8, the inflatable upper pillow cushion portion is preferably covered on the top side with a layer of soft fabric 92, as is further explained below.

The inflatable back cushion portion, inflatable mat cushion portion, inflatable side cushion portions, and the inflatable upper pillow cushion portion, as well as the lengths of thermoplastic sheet material forming the inflatable bath air mattress cushion, are preferably formed from at least two sheets of a flexible, thermoplastic sheet material, with the inflation chambers being formed by heat seal bonding selected regions of the two sheets of thermoplastic material. The thermoplastic material is currently preferably a vinyl plastic such as polyvinyl chloride (PVC), although polyvinyl chloride copolymers, polymers containing the vinyl radical or the vinylidene radical, nylon, linear polyethylene, polystyrene, polypropylene and the like may also be suitable. It is also possible that other types of flexible sheet material could be used, such as various types of rubber, and that other types of seals, such as adhesive seals, may also be feasible. Additional layers of material, such as protective or reflective layers, may also be incorporated in the inflatable bath air mattress cushion.

The layer of soft fabric described above is preferably formed from terry cloth, although other types of cloth, such as cotton or linen sheet, for example, may also be suitable. The fabric is currently preferably bonded to the top side portions of the inflatable bath air mattress cushion with an adhesive such as rubber cement, although other adhesives such as PVC cement, thermosetting adhesives such as epoxy, and hot melt thermoplastic adhesives such as ethylene-vinyl acetate copolymer or polypropylene, for example, may also be suitable.

Figure 9:
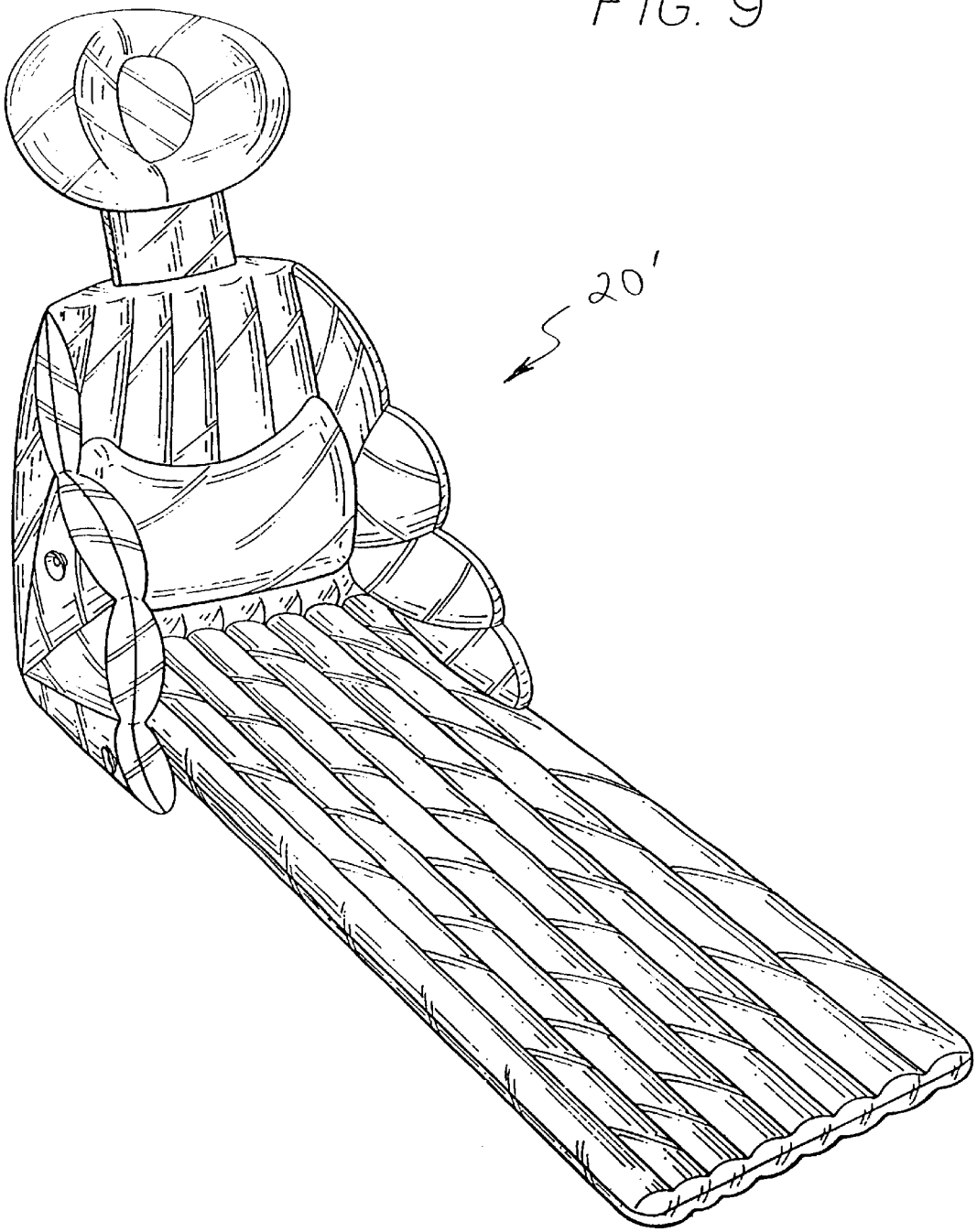
FIG. 9 is a front perspective view of a first alternate embodiment of the bath air mattress cushion of the invention.

Referring to FIG. 9, in a first alternate embodiment, the bath air mattress cushion 20' can be formed from a transparent or translucent thermoplastic material, without a top covering of soft fabric. The features of the first alternate embodiment are otherwise identical to that of the first embodiment, and the bottom side of the inflatable bath air mattress cushion is as is illustrated in FIG. 5.

Figure 10:
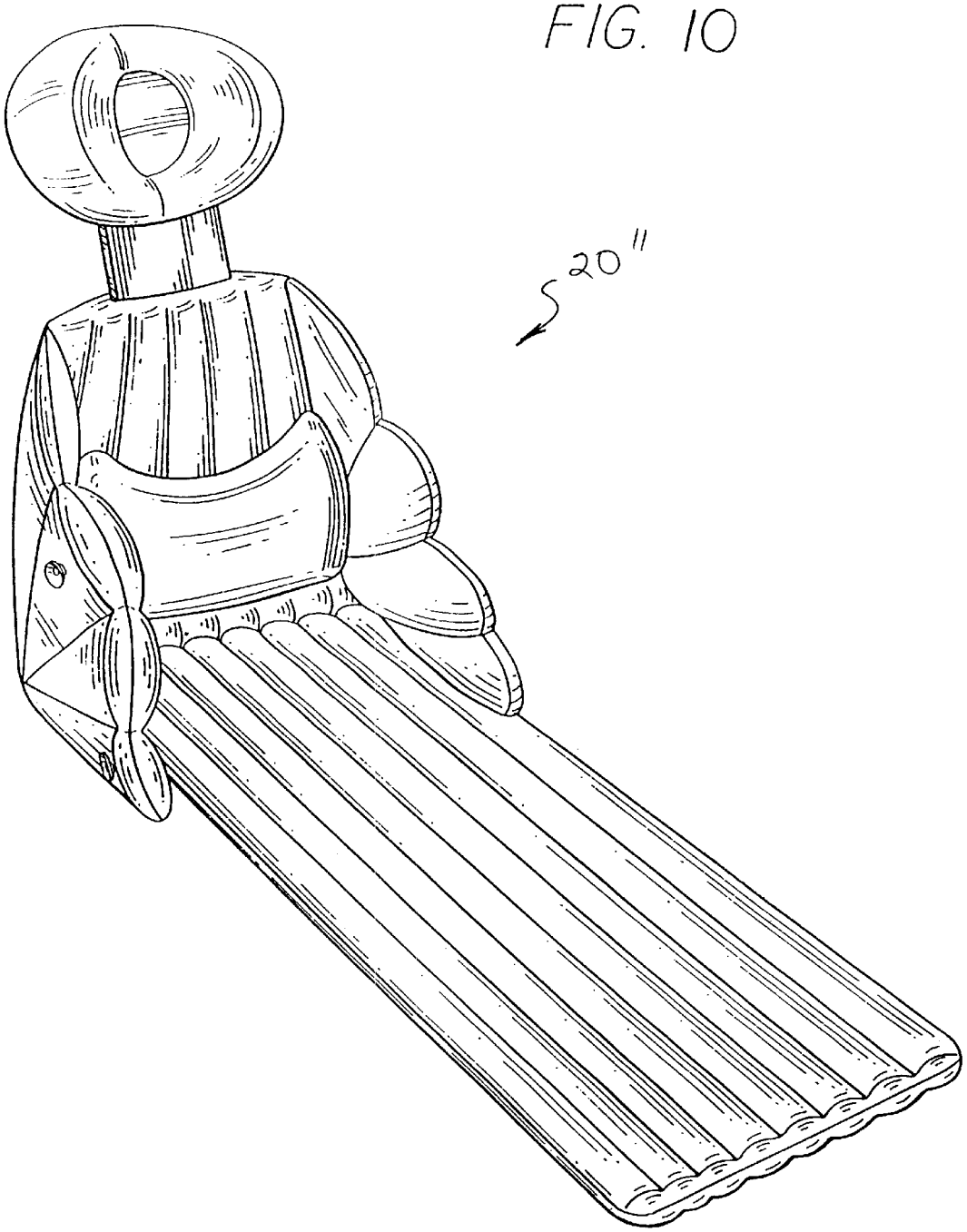
FIG. 10 is a front perspective view of a second alternate embodiment of the bath air mattress cushion of the invention.

Referring to FIG. 10, in a second alternate embodiment, the bath air mattress cushion 20' can be formed from an opaque thermoplastic material, without a top covering of soft fabric. The features of the first alternate embodiment are otherwise identical to that of the first embodiment, and the bottom side of the inflatable bath air mattress cushion is as is illustrated in FIG. 5.

It will be apparent from the foregoing that while particular forms of the invention have been illustrated and described, various modifications can be made without departing from the spirit and scope of the invention. Accordingly, it is not intended that the invention should be limited, except as by the appended claims.

What is claimed is:

1. An inflatable mattress cushion for use in a bath tub, comprising:

an inflatable back cushion portion;

an inflatable mat cushion portion connected to said inflatable back cushion portion by a flexible sheet; and a pair of inflatable side cushion portions connected to opposing sides of said inflatable back cushion portion, wherein each of said inflatable slide cushion portions comprises a plurality of generally triangular shaped tubes having interconnected interior inflation chambers radiating from a common location adjacent said flexible sheet.

2. The inflatable mattress cushion of claim 1, wherein said inflatable back cushion portion and said inflatable mat cushion portion each comprises a plurality of parallel, longitudinally extending tubes having interconnected interior inflation chambers.

3. The inflatable mattress cushion of claim 1, wherein said inflatable back cushion portion further comprises an inflatable back support portion having an interior inflation chamber connected with said interior inflation chamber of said inflatable back cushion portion.

4. The inflatable mattress cushion of claim 1, further comprising at least one suction cup on a bottom side of said inflatable bath air mattress cushion.

5. The inflatable mattress cushion of claim 1, further comprising at least one inflation valve.

6. The inflatable mattress cushion of claim 1, wherein each of said inflatable back cushion portion, said inflatable mat cushion portion, and said side cushion portions has a top side and a bottom side, and wherein said sides of said inflatable back cushion portion, said inflatable mat cushion portion, and said side cushion portions are covered with a soft fabric.

7. The inflatable mattress cushion of claim 1, wherein each of said inflatable back cushion portion, said inflatable mat cushion portion, and said side cushion portions are formed from at least two sheets of thermoplastic material.

8. The inflatable mattress cushion of claim 1, further comprising an inflatable upper pillow cushion portion connected to said inflatable back cushion portion at a side of said inflatable back cushion portion opposing said inflatable mat cushion portion.

9. The inflatable mattress cushion of claim 8, wherein said inflatable upper pillow cushion portion has a top side and a bottom side, and further comprising at least one suction cup on said bottom side of said inflatable upper pillow cushion portion.

10. The inflatable mattress cushion of claim 8, wherein said inflatable upper pillow cushion portion further comprises at least one inflation valve for inflation and deflation of said inflatable upper pillow cushion portion.

11. The inflatable mattress cushion of claim 8, wherein said inflatable upper pillow cushion portion has a top side and a bottom side, and wherein said top side of said inflatable upper pillow cushion portion is covered with a soft fabric.

12. An inflatable bath air mattress cushion for use in a bath tub, comprising:

an inflatable back cushion portion;

an inflatable mat cushion portion connected to said inflatable back cushion portion by a flexible sheet;

a pair of inflatable side cushion portions connected to opposing sides of said inflatable back cushion portion; and an inflatable upper pillow cushion portion connected to siad inflatable back cushion portion at a side of said inflatable back cushion portion opposing said inflatable mat cushion portion, wherein each of said inflatable side cushion portions comprises a plurality of generally triangular shaped tubes having interconnected interior inflation chambers radiating from a common location adjacent said flexible sheet.

13. The inflatable mattress cushion of claim 12, wherein said inflatable back cushion portion and said inflatable mat cushion portion each comprises a plurality of parallel, longitudinally extending tubes having interconnected interior inflation chambers.

14. The inflatable mattress cushion of claim 12, wherein said inflatable back cushion portion further comprises an inflatable back support portion having an interior inflation chamber connected with said interior inflation chamber of said inflatable back cushion portion.

15. The inflatable mattress cushion of claim 12, wherein each of said inflatable back cushion portion, said inflatable mat cushion portion, said side cushion portions, and said inflatable upper pillow cushion portion has a top side and a bottom side, and further comprising at least one suction cup on said bottom sides of each of said inflatable back cushion portion, said inflatable mat cushion portion, said side cushion portions, and said inflatable upper pillow cushion portion.

16. The inflatable mattress cushion of claim 12, wherein each of said inflatable back cushion portion, said inflatable mat cushion portion, said side cushion portions, and said inflatable upper pillow cushion portion further comprises at least one inflation valve.

17. The inflatable mattress cushion of claim 12, wherein each of said inflatable back cushion portion, said inflatable mat cushion portion, said side cushion portions, and said inflatable upper pillow cushion portion has a top side and a bottom side, and wherein said top sides of each of said inflatable back cushion portion, said inflatable mat cushion portion, said side cushion portions, and said inflatable upper pillow cushion portion are covered with a soft fabric.

18. The inflatable mattress cushion of claim 12, wherein each of said inflatable back cushion portion, said inflatable mat cushion portion, said side cushion portions, and said inflatable upper pillow cushion portion are formed from at least two sheets of thermoplastic material.

19. An inflatable bath air mattress cushion for use in a bath tub, said inflatable bath air mattress cushion being formed from at least two sheets of thermoplastic material heat bonded together, said inflatable bath air mattress cushion comprising:

a middle inflatable back cushion portion having a top side and a bottom side;

an inflatable lower mat cushion portion connected to said middle inflatable back cushion portion by a flexible sheet, said inflatable lower mat cushion portion a pair of inflatable side cushion portions connected to opposing sides of said middle inflatable back cushion portion, each of said inflatable side cushion portions having a top side and a bottom side, and each of said inflatable side cushion portions being formed from a plurality of generally triangular shaped tubes having interconnected interior inflation chambers radiating from a common location adjacent to the flexible sheet;

an inflatable upper pillow cushion portion having a top side and a bottom side, said inflatable upper pillow cushion portion being connected to said middle inflatable back cushion portion at a side of said middle inflatable back cushion portion opposing said inflatable lower mat cushion portion; and a layer of soft fabric bonded to said middle top sides of each of said inflatable back cushion portion, said inflatable lower mat cushion portion, said side cushion portions, and said inflatable upper pillow cushion portion.

20. The inflatable bath air mattress cushion of claim 19, wherein said middle inflatable back cushion portion further comprises an inflatable back support portion having an interior inflation chamber connected with said interior inflation chamber of said middle inflatable back cushion portion.

21. The inflatable bath air mattress cushion of claim 19, further comprising at least one suction cup disposed on said bottom sides of each of said middle inflatable back cushion portion, said inflatable lower mat cushion portion, said side cushion portions, and said inflatable upper pillow cushion portion.

22. The inflatable bath air mattress cushion of claim 19, wherein each of said middle inflatable back cushion portion, said inflatable lower mat cushion portion, said side cushion portions, and said inflatable upper pillow cushion portion further comprises at least one valve.

* * * * *